United States Patent [19]

Buryšek et al.

[11] 4,040,573

[45] Aug. 9, 1977

[54] METHOD OF AND APPARATUS FOR TRANSPORTING EMPTY BOBBIN TUBES TO A PICK-UP AND DELIVERY STATION IN OPEN-END SPINNING, WINDING, YARN TEXTURING AND SIMILAR MACHINES

[75] Inventors: František Buryšek, Usti nad Orlici; Karel Mikulecký, Chocen; Jan Janoušek, Brandys nad Orlici, all of Czechoslovakia

[73] Assignee: Vyzkumny ustav bavlnarsky, Usti nad Orlici, Czechoslovakia

[21] Appl. No.: 714,778

[22] Filed: Aug. 16, 1976

[30] Foreign Application Priority Data

Aug. 28, 1975 Czechoslovakia ..... 5860/75

[51] Int. Cl.[2] ..... B65H 54/26; B65H 67/06

[52] U.S. Cl. ..... 242/35.5 A; 57/53

[58] Field of Search ..... 242/35.5 A, 35.5 R, 242/35.6 R; 57/53

[56] References Cited

U.S. PATENT DOCUMENTS

| | | | |
|---|---|---|---|
| 3,480,128 | 11/1969 | Brouwer et al. | 242/35.5 R X |
| 3,774,859 | 11/1973 | Brouwer et al. | 242/35.5 A X |
| 3,913,853 | 10/1975 | Raasch | 242/35.5 A X |
| 3,933,320 | 1/1976 | Tsurumi et al. | 242/35.5 R |
| 3,939,634 | 2/1976 | Yoshizawa et al. | 242/35.5 A X |
| 3,966,141 | 6/1976 | Nishiyama et al. | 242/35.5 A |

*Primary Examiner*—Stanley N. Gilreath

[57] ABSTRACT

A method and an apparatus for conveying empty bobbin tubes through a channel member which extends longitudinally along a plurality of working units of an open-end spinning, winding, yarn texturing or similar machine. The apparatus of the invention includes a transporting member which is operatively mounted on the machine so as to move in a stepwise manner along the plurality of working units of the machine. The machine includes a bobbin supply and withdrawing station opposite each working unit. The transporting member is adapted to move in a stepwise manner from one bobbin withdrawing and supply station to the next adjacent one. The apparatus further includes a channel member extending longitudinally along the plurality of working units. A plurality of empty bobbin tubes are disposed in the channel member end-to-end so as to form a column. The transporting member has a carrier member extending therefrom towards the channel member. The carrier member is adapted to push the column of empty bobbin tubes along the channel member when the transporting member moves from one bobbin supply and withdrawing station to the next one. The transporting member is also adapted to exchange a fully wound bobbin by an empty bobbin which is removed from the channel member.

3 Claims, 7 Drawing Figures

FIG. 1
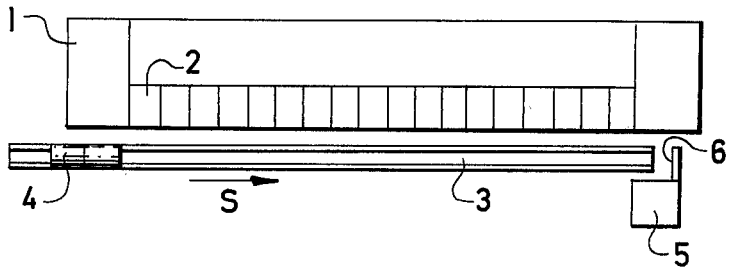
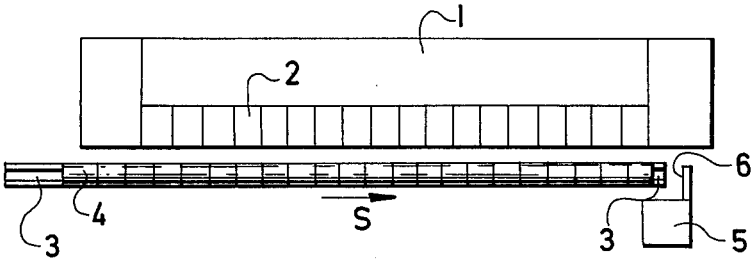
FIG. 2
FIG. 3
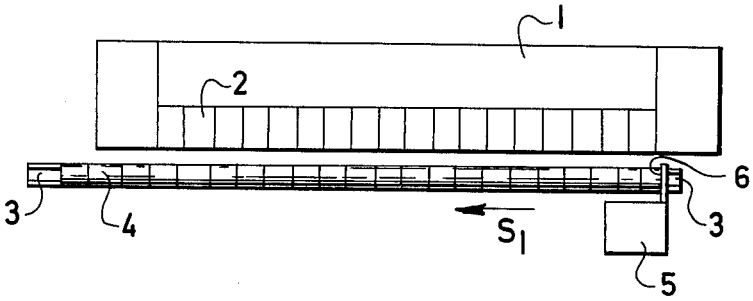
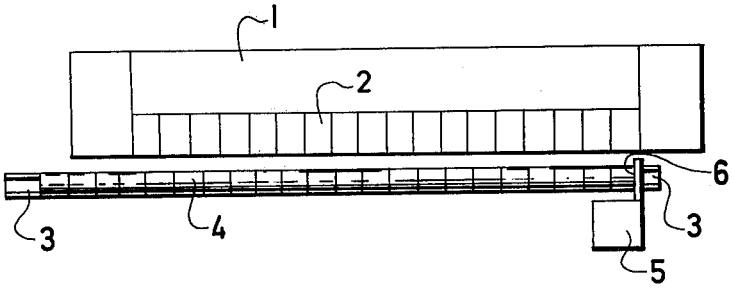
FIG. 4
FIG. 5
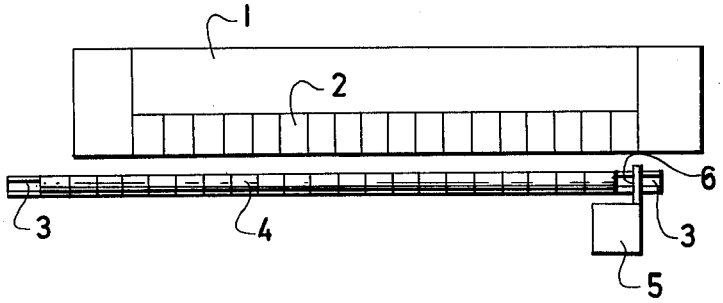
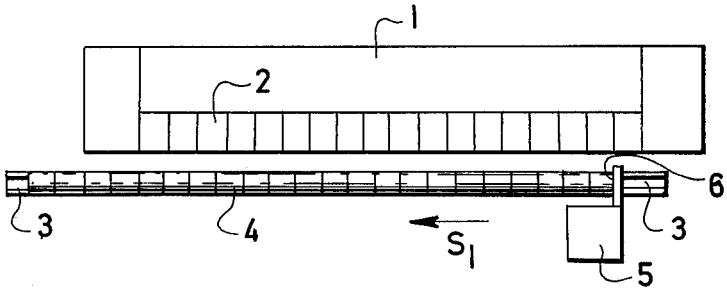
FIG. 6

METHOD OF AND APPARATUS FOR TRANSPORTING EMPTY BOBBIN TUBES TO A PICK-UP AND DELIVERY STATION IN OPEN-END SPINNING, WINDING, YARN TEXTURING AND SIMILAR MACHINES

BACKGROUND OF THE INVENTION

The present invention relates to a method of and an apparatus for transporting empty bobbin tubes through a channel member to a bobbin supply and withdrawing station. The device is adapted to be used in open-end spinning, winding, yarn texturing and similar machines having a plurality of separate working units. The device includes a transporting or travelling member which is adapted to automatically exchange bobbins. The empty bobbins are adapted to be conveyed along a channel which is disposed longitudinally along the textile machine and includes means for transporting the empty bobbins along the channel.

Open-end spinning, winding, yarn texturing and similar machines generally include a plurality of working units which are arranged side-by-side and are provided with a transporting member which is adapted to automatically exchange bobbins.

There are already known a number of devices for supplying the individual working units of the textile machine with empty bobbins.

In such an arrangement of the state of the art, the transporting device includes a bulky and cumbersome bobbin tube magazine which moves jointly with the device. This arrangement of the state of the art has the drawback of being quite large and of complex construction and, therefore, costly.

Also forming part of the state of the art is an arrangement which has a stationary tubular magazine mounted on each working unit. These magazines have to be refilled periodically with empty tubes by the machine operator. This known arrangement has similar drawbacks as the arrangement described above.

There is also known a somewhat simpler arrangement for conveying bobbin tubes to a supply and withdrawing station for individual working units of a textile machine of the afore-described character. In this known arrangement, the bobbin tubes are arranged in an end-to-end column formation and this formation is axially moved through a channel by conveying means.

This known arrangement is advantageous because of its relative simplicity and operational reliability. However, it has not been found to be reliable for an automatic bobbin exchange operation because the length of the tube differs from the working unit distance pitch. Therefore, it is necessary for a machine operator to manually subsequently place an empty bobbin tube opposite the supply and withdrawing station of the respective working unit.

It is furthermore known to supply and convey empty bobbin tubes along a channel by means of an endless toothed chain or belt. The spacing between two adjacent teeth of the chain correspond to the working unit pitch (distance). The chain or belt is moved step-by-step so that the individual teeth always stop opposite the withdrawing and supply station of the working units.

The aforedescribed arrangement is, however, quite complex and expensive and is also subject to frequent malfunction.

SUMMARY OF THE INVENTION

It is an object of the present invention to provide a simple and operationally reliable method and arrangement for conveying empty bobbin tubes through a channel to a withdrawing and supply station for working units of an open-end spinning, winding, yarn texturing and similar machine. The arrangement of the invention includes a transporting mechanism that is operated in a stepwise manner and serves to automatically exchange bobbins. The arrangement of the invention is simple, inexpensive and space-saving and carries out the method of conveying empty bobbin tubes into the supplying and withdrawing stations in open-end spinning, winding, yarn texturing and similar machines. The arrangement of the invention includes a transporting mechanism which is operated in a stepwise manner and is adapted to automatically exchange the bobbins. The arrangement further includes a channel for conveying the empty bobbin tubes along the textile machine and means for transporting the tubes through a channel.

In accordance with the invention, the above method of conveying empty bobbin tubes to the stations opposite the working units of the textile machine, where the fully-wound bobbins are withdrawn and replaced by empty bobbins, is characterized by conveying the empty bobbin tubes through a channel in an end-to-end column formation. As the transporting mechanism moves in stepwise manner, the tubes are pushed forward by a portion of the transporting mechanism between two adjacent working units so that the leading tube arrives at the station for supplying and withdrawing bobbin tubes opposite the corresponding working unit from which it is subsequently withdrawn by an appropriate mechanism. Any mechanism suitable for an automatic bobbin exchange operation can be used for the aforedescribed purpose in the method of this invention.

The apparatus in accordance with this invention includes means for moving the column of bobbin tubes through a channel. These means include a carrier member mounted on an automatic bobbin exchange device which is adapted to move into the path of the bobbin tubes along the channel.

The carrier member is preferably embodied as a plate which is shaped in accordance with the cross-section of the channel and is freely movable therein.

The apparatus in accordance with the present invention can be easily installed in existing textile machines.

BRIEF DESCRIPTION OF THE DRAWING

A preferred embodiment of the apparatus for carrying out the method according to the present invention will now be described with reference to the accompanying schematic drawings which are not intended to limit the scope of the invention in any way. In the drawings:

FIGS. 1 and 2 are plan views of a textile machine having an apparatus for carrying out the method of the present invention wherein the step of filling a channel of the textile machine with empty bobbin tubes is illustrated;

FIGS. 3–6 are views similar to FIGS. 1 and 2 wherein various stages of the process for exchanging fully-wound bobbin tubes with empty bobbin tubes are illustrated schematically.

DESCRIPTION OF A PREFERRED EMBODIMENT

Figure 7:
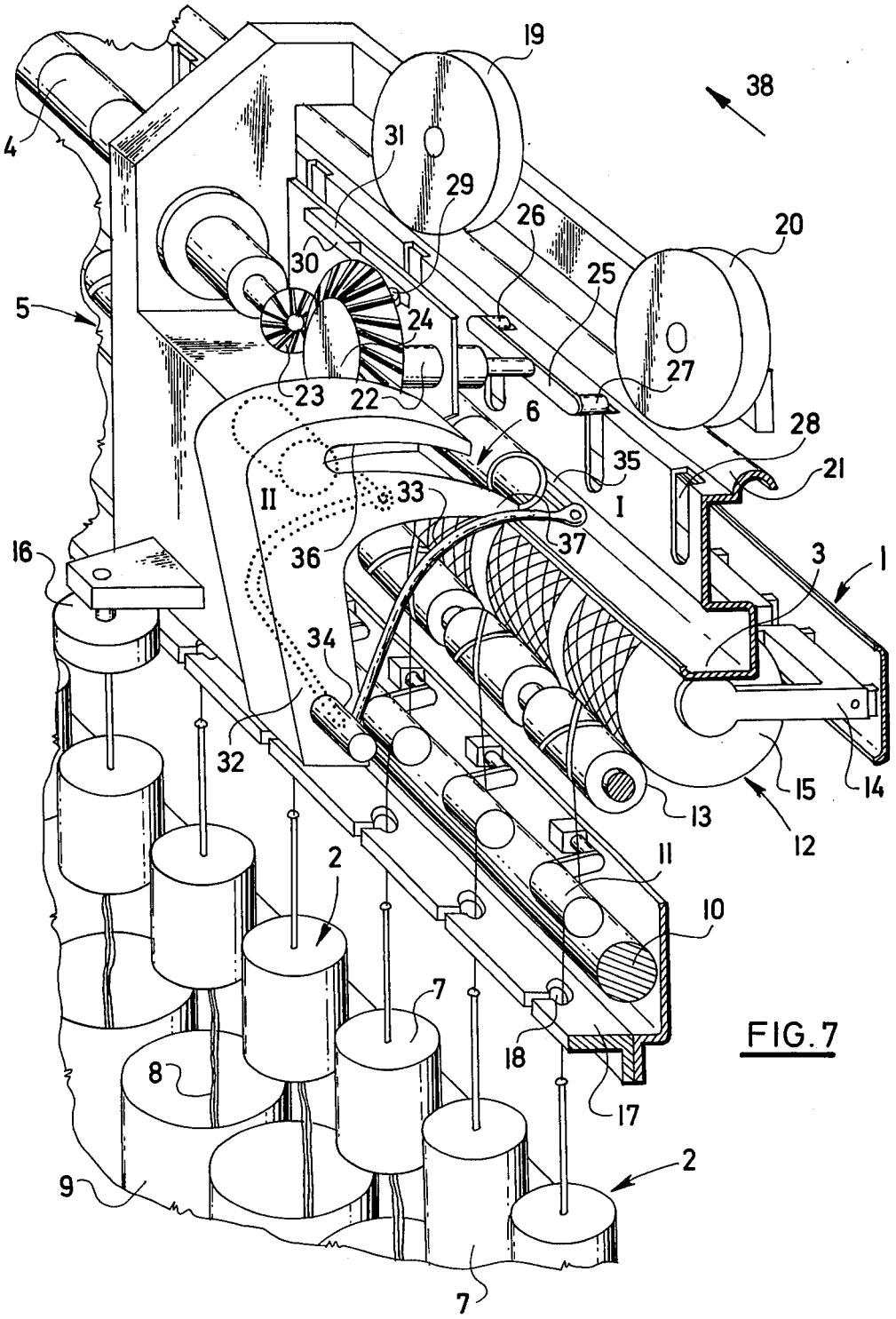
FIG. 7 is an illustration in perspective of a preferred embodiment of the apparatus of the invention in an open-end spinning machine.

As illustrated in FIGS. 1–6, a textile machine 1, such as, for example, an open-end rotor spinning machine, comprising a plurality of working units 2 which are arranged side-by-side in the frame of the machine 1, is shown. The arrangement includes a channel member 3 which extends longitudinally along the machine 1. The channel member 3 serves to support and convey a plurality of empty bobbin tubes 4 to a number of bobbin withdrawing and supply stations. These stations correspond in number to the number of working units 2 in the machine 1. The empty bobbin tubes 4 are manually placed into the channel member 3. However, these bobbin tubes 4 can also be automatically placed by a suitable device into the channel member 3.

The arrangement further includes a well-known transporting member which is adapted to be operatively moved along the machine 1 in a stepwise manner. The transporting member is adapted to automatically exchange bobbins and has been designated with the reference number 5. This member 5 can be moved from a position opposite a working unit 2 to a position opposite the next adjacent working unit 2, etc. The operation of the transporting member 5 will now be described in greater detail.

The transporting member 5 and the manner of its operation is illustrated in detail in FIG. 7. Thus it can be seen that the open-end spinning machine 1 includes a plurality of working units 2, each of which cooperates with a spinning unit 7 to which a sliver 8 from a can 9 is fed. The machine 1 further includes a main yarn take-off roller 10 which cooperates with a plurality of secondary freely floatable rollers 11. The machine 1 further includes a take-up device 12 which has a plurality of bobbin holders 14 and a corresponding plurality of traversing rollers 13. The bobbin holders 14 each support a bobbin to be wound with yarn. The traversing rollers 13 serve to cross-wind the yarn onto the bobbins 15.

The transporting member 5 for automatically exchanging a cross-wound bobbin 15 for an empty bobbin, is adapted to travel along the open-end spinning machine 1. This transporting member 5 is provided with its own electromotric driving means (not illustrated in detail). These driving means are adapted to move the transporting member 5 in a stepwise manner from one working unit 2 to the next one. The transporting member 5 is adapted to exchange fully cross-wound bobbins 15 for empty bobbins 4 which are disposed in the channel member 3 where they form an end-to-end column formation.

The transporting member 5 is movable along the open-end spinning machine 1 by means of a first roller 16 adapted to move along a rail 17. The rail 17 also serves simultaneously as a bar having a plurality of yarn guide eyelets 18. The transporting member 5 is further supported on a pair of rolls 19 and 20 which are adapted to move along a rail 21 mounted on the machine frame of the machine 1.

The stepwise movement of the transporting member 5 along the machine 1 is effected by means of a shaft 22, which is positively driven via a gearing mechanism of which only a worm 23 and a worm wheel 24 are illustrated in detail. The guiding means for the transporting member 5 further include an electromagnetic clutch (not illustrated in detail). The shaft 22 supports a two-armed level 25 which has at its opposite ends the pins 26 and 27 projecting therefrom. These pins are adapted to alternately engage into slots 28 on the rail 21. The worm wheel 24 is, furthermore, provided with a lug 29 projecting therefrom and jointly rotating therewith. This tripping lug 29 describes a path in which lies an arm 30 of a microswitch 31. As the microswitch 31 is tripped by the tripping member 29, it engages or disengages the electromotric driving means and the gearing mechanism.

The transporting member 5 is further provided with a mechanism (not illustrated in detail) for exchanging a cross-wound bobbin 15 for an empty bobbin 4. This mechanism is also not fully illustrated in detail. The transporting member 5 includes a receptacle 32 on which there is pivotally mounted via a rocking shaft 34 a supply lever 33. The motion of the rocking shaft 34 is controlled by a cam mechanism (not illustrated in detail). The cam mechanism is driven by the electromotric driving means via a gearing. A supply lever 33 has a peg 35 extending from its free end and adapted to move between two limit positions I and II. The position II is shown in phantom lines in FIG. 7. The peg 35 is shown in full lines in its position I, wherein the supply lever 33 is moved behind the leading tube 4 of the tube column, said leading bobbin tube 4 being at the bobbin withdrawing and supply station. As the supply lever 33 is rocked toward its limit position II, the empty bobbin tube 4 is moved into the receptacle 32 by means of the action of the supply lever 33 which can move inward relative to the receptacle 32 because such movement is made possible by the lateral slit 36 into which the peg 35 extends as the lever 33 moves inwardly relative to the receptacle 32.

The transporting member 5 is further provided with a carrier member 6 embodied as an extended lower part 37 of the lateral slit 36 and adapted to move into the path of the series of empty bobbin tubes 4 in the channel member 3. Thus after the leading bobbin in the column of empty bobbin tubes 4 has been removed in the bobbin supply and withdrawing station, it is evident that a free space is left between the carrier member 6 of the transporting member 5 and the next bobbin in the column of empty bobbins, the length of this space equalling the length of the withdrawn bobbin.

During the next step of the transporting member 5 the carrier member 6 has to cover first said free space (idle run), which means that it will not engage the empty bobbin column during this time interval. In a further phase of the stepwise movement of the carrier member 6 it comes into contact with the empty bobbin column and shifts said column forward a distance which is logically shorter than the overall length of the step of the transporting member 5. The length of this path of the bobbin column movement is equal to a fraction of the step of the whole transporting member 5; the next leading bobbin arrives again at the bobbin supply and withdrawing station whereupon the whole working cycle is repeated. As the transporting member 5 moves from a station in front of one working unit 2 to the station in front of the adjacent working unit 2, the carrier member 6 pushes the column of empty bobbin tubes 4 along the channel member 3 a fraction of a distance equivalent to the distance between two adjacent working units 2.

In operation, the transporting member 5 moves in a step-by-step manner along the rails 17 and 21 in the direction of the arrow 38, Sl (see FIGS. 3, 6 and 7). The movement of the transporting member 5 is effected via the alternate engagement of the pins 26 and 27 in the slots 28 of the rail 21. The stepwise movement of the transporting member 5 is controlled by the tripping lug 29 as it trips the arm 30 of the microswitch 31. The microswitch 31 disengages and re-engages the electromagnetic clutch at intervals corresponding to 180° angular displacement of the two-armed lever 25. After the transporting member 5 has come to a complete standstill, the lever 33 is moved from the position I to the position II. The carrying peg 35 of the lever 33 thereby pushes the leading empty bobbin tube 4, which is situated in the bobbin tube withdrawing position, into the receptacle 32. Thereafter the actual exchange between the fully-wound bobbin 15 and an empty bobbin 4 is carried out is a well-known manner. Before the next step of the transporting member 5 is effected, the supply lever 33 is returned to its starting position I and the carrying peg 35 is positioned again behind the column of empty bobbin tubes 4. During the next step of the transporting member 5 the whole column of empty bobbin tubes 4 is pushed by the carrier member 6 in the direction of the arrow 38, Sl until it has reached the next withdrawing and bobbin supply station opposite the next following working unit 2. After this stepwise movement has been completed, the carrying peg 35 is again disposed directly behind the leading tube 4 of the column of empty bobbin tubes 4 which is positioned at the bobbin supply withdrawing station, and thereafter the whole aforedescribed cycle is repeated.

It can be noted that the apparatus for actually carrying out the bobbin exchange between fully-wound bobbins 15 and empty bobbin tubes 4 is not described or illustrated because the method and mechanism of the invention are directed towards the conveying of empty bobbin tubes to the bobbin withdrawing and supply station for each working unit 2. It should be noted, however, that any conventional known mechanism for exchanging bobbins can be used with the arrangement of this invention. Furthermore, the stepwise motion of the transporting member 5 can be effected by other suitable known means. However, the essential feature of the transporting member 5 which forms part of this invention, resides in that the movement of the transporting member 5 is carried out in steps from a bobbin supply and withdrawing station in front of one working unit 2 to the station in front of the adjacent working unit 2. Furthermore, the feature of using the movement of the transporting member 5 to simultaneously convey the empty bobbin tubes 4 to the aforementioned stations in front of the working units also forms part of the method and apparatus of this invention.

The transporting member 5 is provided with a carrier member 6 as has been described hereinabove. The carrier member 6 interferes and moves into the path of movement of the empty bobbin tubes 4 in the channel member 3. The carrier member 6 is preferably embodied as a plate which has a shape that conforms substantially to the cross-sectional shape of the channel member 3 and which is freely movable in said channel member 3. The carrier member 6, however, can also be shaped differently. What is essential is that this carrier member 6 (or its equivalent means) be adapted to move the column of empty bobbin tubes 4 through the channel member 3. Furthermore, it is necessary that this carrier member 6 move into the path of the column of tubes 4 in the channel member 3 so that it may push the column of empty bobbin tubes along the channel member 3.

In operation the empty bobbin tubes 4 are either manually, or automatically, laid into the channel member 3 at its left-hand extremity (see FIG. 1), so as to form and end-to-end column configuration of empty bobbin tubes 4 in the channel member 3. The empty bobbin tubes 4 are being pushed manually or mechanically towards the right extremity through the channel member 3 and along the working units 2 in the direction of the arrow S (see FIGS. 1 and 2) until a column formation of empty bobbin tubes 4 fills the channel 3. After the channel member 3 has been so filled (see FIG. 2), the transporting member 5 is set in motion and begins to move in a stepwise manner in the direction of the arrow Sl (see FIG. 3) towards the bobbin supply withdrawing station opposite the first working unit 2 where it comes to a standstill (see FIG. 4). As the transporting member 5 moves towards the left in a stepwise manner, it pushes the column of empty bobbin tubes 4 along the channel member 3. When the transporting member 5 comes to a standstill, the leading empty bobbin tube 4 is positioned at the bobbin withdrawing and supply station opposite the working unit 2 from which it is withdrawn by the aforedescribed mechanism of the transporting member 5 and is exchanged by any conventional bobbin exchange mechanism.

FIG. 5 illustrates the arrangement of the invention after an empty bobbin tube 4 has been removed from the channel member 3.

After the leading bobbin in the column has been removed in the bobbin supply and withdrawing station a free space is left between the carrier member 6 of the transporting member 5 and the next bobbin in the column, the length of said space equalling the length of the bobbin withdrawn.

After the bobbin exchange has been completed, the transporting member 5 takes another step in the direction of the arrow Sl. At first the carrier member 6 rungs idle in said free space until it engages the bobbin column and pushes it forward a distance which is a fraction of the length of the step of the transporting member 5. By this movement of the bobbin column the leading bobbin 4 now arrives at the next bobbin supply and withdrawing station opposite the following working unit 2 (FIG. 6) whereupon the whole operation aforedescribed cycle is repeated.

An overlapping of the movements of the column of empty bobbin tubes 4 relative to the pitch (distance) between the working units 2 of the textile machine 1, is always ensured because the length of each tube 4 is always somewhat shorter than the pitch (distance) between the working units 2.

The mechanism for withdrawing empty bobbin tubes from the channel member 3 at each bobbin supply and withdrawing station and exchanging it with a full bobbin has not been described in greater detail because this device constitutes actually a part of the apparatus for automatically exchanging bobbins. The invention, as stated hereinabove, is primarily concerned with the method and apparatus for conveying empty bobbin tubes 4 to the respective bobbin supply and withdrawing stations of the textile machine.

Although the invention is illustrated and described with reference to a preferred embodiment of the method and apparatus thereof, it is to be expressly understood that it is in no way limited by the disclosure of such an embodiment, but is capable of numerous modifications within the scope of the appended claims.

What is claimed is:

1. A method of conveying empty bobbin tubes through a channel member extending along a plurality of working units of open-end spinning, winding, yarn texturing and similar machines having a transporting member adapted to automatically exchange a fully-wound bobbin for an empty bobbin at a bobbin withdrawing and supply station, comprising the steps of moving a plurality of empty bobbins along said channel member in an end-to-end column formation in a stepwise manner, said transporting member also moving in a stepwise manner along said channel member, said transporting member pushing said end-to-end column formation of empty bobbin tubes along said channel member a distance corresponding to a fraction of its stepwise movement and the distance of each step corresponding to the distance between adjacent working stations, whereby the leading empty bobbin tube of said column formation is positioned at the next following bobbin withdrawing and supply station from which it is subsequently withdrawn by said transporting member.

2. An apparatus for conveying empty bobbin tubes to a plurality of working units of open-end spinning, winding, yarn texturing and similar machines, comprising in combination, a frame, a transporting member operatively movably mounted on said frame and adapted to longitudinally move in a stepwise manner along said plurality of working units from a bobbin supply and withdrawing station opposite a working unit to the next station opposite the adjacent working unit, a channel member supported on said frame and adapted to hold a plurality of empty bobbin tubes arranged end-to-end and forming a column in said channel member, carrier means extending from said transporting member towards said channel member and adapted to move jointly with said transporting member;

said carrier means being adapted to engage the leading empty bobbin tubes of said column of empty bobbin tubes and to push said column so that it moves jointly with said transporting member.

3. The apparatus as set forth in claim 2, wherein said channel member has a cross-sectional shape and said carrier means includes a plate having a mating cross-sectional shape.

* * * * *